United States Patent [19]

Hofman

[11] Patent Number: 4,583,879

[45] Date of Patent: Apr. 22, 1986

[54] PAVING METHOD AND GRAB FOR USE IN SAID METHOD

[75] Inventor: Hendrik Hofman, Rotterdam, Netherlands

[73] Assignee: Aannemingsbedrijf Luymes & Bal en van der Straaten B.V., An Ridderkerk, Netherlands

[21] Appl. No.: 571,569

[22] Filed: Jan. 17, 1984

[30] Foreign Application Priority Data

Jan. 21, 1983 [NL] Netherlands ..... 8300230

[51] Int. Cl.[4] ..... E01C 19/52

[52] U.S. Cl. ..... 404/73; 404/99; 294/67.31; 294/87.1; 414/740; 52/747

[58] Field of Search ..... 404/73, 99; 294/63 R, 294/67 BC, 81 R, 87 R, 63.1, 67.31, 81.2, 81.5, 87.1; 52/745, 747, 749; 414/739, 740

[56] References Cited

U.S. PATENT DOCUMENTS

| | | | |
|---|---|---|---|
| 2,095,414 | 10/1937 | Hemstreet et al. | 404/104 |
| 2,784,923 | 3/1957 | Sepke | 294/67.32 |
| 3,098,673 | 7/1963 | Carlesimo | 294/63.1 |
| 4,168,130 | 9/1979 | Barth et al. | 404/99 |
| 4,194,853 | 3/1980 | Barth et al. | 404/99 X |
| 4,320,985 | 3/1982 | Kleinemas | 404/99 |
| 4,383,788 | 5/1983 | Sylvander | 414/71 |
| 4,479,739 | 10/1984 | Schweikert | 404/99 |

FOREIGN PATENT DOCUMENTS

| | | | |
|---|---|---|---|
| 241752 | 10/1965 | Austria | 294/104 |
| 768524 | 10/1967 | Canada | 294/81.61 |
| 3006652 | 8/1981 | Fed. Rep. of Germany | 404/73 |
| 3133661 | 3/1983 | Fed. Rep. of Germany | 404/73 |

*Primary Examiner*—Stephen J. Novosad
*Assistant Examiner*—John F. Letchford
*Attorney, Agent, or Firm*—Weingarten, Schurgin, Gagnebin & Hayes

[57] ABSTRACT

A paving method and a grab for carrying out the method. A group or unit of paving stones or bricks, arranged in a selected pattern, is clamped, picked up, and laid on a prepared sand bed, in contiguity with paving components already laid, by releasing the clamping and pressing against said paving components. Tilting or jamming of stones or bricks is prevented by the exercise of a downward force on at least the border stones or bricks or border rows bordering the paving components referred to at least at the moment when the clamping is released.

8 Claims, 3 Drawing Figures

PAVING METHOD AND GRAB FOR USE IN SAID METHOD

Figure 1:
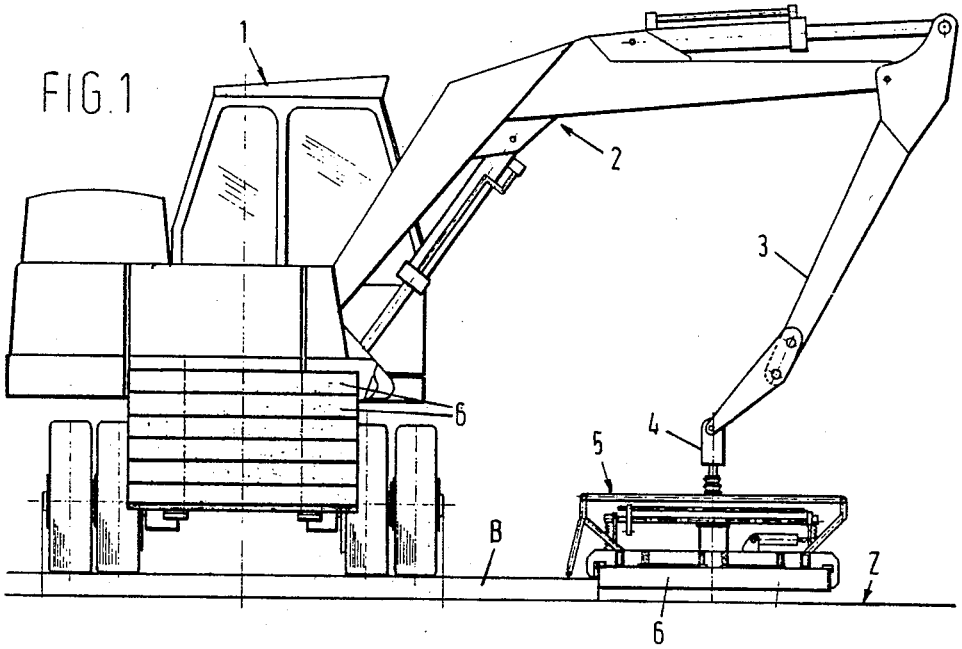

This invention relates to a method of laying paving, in particular of placing units of paving stones or bricks previously arranged in a selected pattern in a road surface, said method comprising engaging such a unit by clamping at opposite edges and putting it down on a prepared sand bed or like substrate in contiguity with previously laid road surface components while pressing the same into contact with such road surface components, and with a downward force to be exerted on the upper surface of said unit.

In a similar method described in German "Offenlegungsschrift"No. 1,534,201, the units or groups of stones or bricks are prefabricated by manufacturers and supplied in stacked condition on pallets. By means of a grab, one unit at a time is bilateraly engaged and clamped in such a manner that the unit can be lifted from the stack while maintaining its previously arranged pattern. The unit is then moved to be held over a desired location next to a previously laid paving component, whereafter the lateral clamping is released and the unit of stones or bricks falls into position on the prepared sand bed, which has a loose upper layer. By means of a hold-down plate the stones or bricks are subsequently pressed into the loose upper layer.

One disadvantage of this known method and the grab used therein is that, although naturally the grab releases each unit in as close contiguity with a previously laid paving component as possible, and as closely above the substrate as possible, in practice, as a unit of stones or bricks is released, the pattern in which the stones or bricks have been accurately arranged beforehand is disturbed owing to the rows of border stones or bricks of the unit being tilted and/or owing to wedge action against adjacent rows of stones or bricks, and partly as a consequence of this gaps are often formed between the stones or bricks. As a consequence, each time after a unit of stones or bricks has been laid, relatively much manual work is required for correction. This drawback is aggravated if no use is made, as in the prior method, of formed or profiled stones or bricks, which exhibit a certain coherence owing to their interengaging forms, but of rectangular, cubical stones or bricks, in particular, if it is desired for them to be laid in contact with each other without seams.

It is an object of the present invention to eliminate this drawback.

This is achieved, according to the invention, by providing a method of the kind defined in the opening paragraph hereof, characterized in that the downward force is exerted on at least the border stones or bricks or border rows bordering the previously laid road surface component at least at the moment when, as the unit is laid down, the clamping at the edges thereof is released.

Although, as the lateral clamping is released, the border stones or bricks of a unit experience friction from each clamping strip or jaw of the grab, owing to which they do not fail vertically downwardly, but tend to tilt, the row or rows of border stones or bricks contiguous with the ready road surface component will be additionally prevented from falling vertically downwardly owing to the great friction they experience from the ready road surface component as they are moving downwards. By using the method according to the invention the frictional forces referred to are now prevented from tilting the border stones or bricks concerned because these border stones or bricks remain clamped between, on the one hand, the road surface already laid and, on the other hand, the middle stones or bricks of the unit or group throughout their path of movement right down to the substrate, and are thereby pressed positively downwards.

To ensure that the friction against the other clamping strips or jaws of the grab has no adverse effect on the true vertical movement of the border stones or bricks concerned either, according to the invention, during the release of the unit, a downward force can be exerted on each row of border stones or bricks, and this per row of border stones or bricks independently of the exercise of force on the other rows of border stones or bricks.

The invention also relates to a grab comprising a frame including suspension means for attachment to a jib of a swivelling crane, and at least one pair of opposite clamping strips cooperating for clamping a unit or group of stones or bricks previously arranged in a pattern, one clamping strip being arranged so as to be movable, and the other being rigid relatively to said frame, said frame further carrying a holddown mechanism operative vertically downwardly, as disclosed in German "Offenlegungsschrift" No. 1,534,201. According to the present invention, this grab is characterized in that said hold-down mechanism is operative along at least the inside of said movably arranged clamping strip.

After a unit of stones or bricks has been picked up with the grab, it is placed with the bottom portions of the border stones or bricks, which are engaged by the movable clamping strip, into contact with a ready part of the paving, and the unit is held in spaced parallel relationship to the substrate, for example, a smoothed sand bed, and horizontally compressed by the rigid clamping strip. Subsequently, the working surface of the movable clamping strip is moved away from the opposed rigid clamping strip. During this opening of the movable clamping strip, the clamping force is reduced, so that the weight of the unit overcomes the friction against the clamping strips, and the unit falls onto the sand bed. The border stones or bricks which, for them to be able to fall, additionally have to overcome the lateral friction from the earlier laid pavement, are thereby helped by the hold-down mechanism working vertically on them.

A simple and effective hold-down mechanism according to the present invention comprises one or more hold-down strips each biased downwardly by spring means, said spring means being secured to a tensioning frame movable relatively to the carrier frame between a passive and an active level.

For picking up a unit or group of stones or bricks the tensioning frame is moved upwards, so that the apparatus can be lowered onto a stack of units of stones or bricks without being hindered by the hold-down strips. When the uppermost unit has been engaged, the tensioning frame is moved to the lower, active position, as a result of which the hold-down strips are pressed down on to the respective rows of border stones or bricks, and can force these downwardly as soon as the lateral clamping has been sufficiently released.

In a further elaboration of the invention, the grab is provided with a supporting rail secured to the carrier frame along the outside of at least one of the clamping strips and at least one supporting plate spaced from said supporting rail, the levels of said supporting rail and of said supporting plate being adjustable so as to enable them to function as level positioning means relative to paving already laid and relative to the sand bed or other substrate.

In this arrangement, according to the invention, a hand rail may be provided for maneuvring the grab. Thus the last phase of the positioning of a unit, including forcing it into contact with the ready part of the pavement, can be carried out manually.

In order that the jib of the swivelling crane may not interfere with these operations, according to the invention, the suspension means whereby the carrier frame is suspended from the swivelling crane preferably includes a combination of universal joint means and freewheel joint means.

When the unit has been brought approximately over the desired location by the swivelling crane, the correct horizontal position may be found by maneuvering by means of the hand rail, and when the grab is further lowered it comes to rest on the supporting rail and the supporting plate. Owing to the freewheel clutch, further downward movements of the crane jib can no longer adversely affect this position found.

Figure 2:
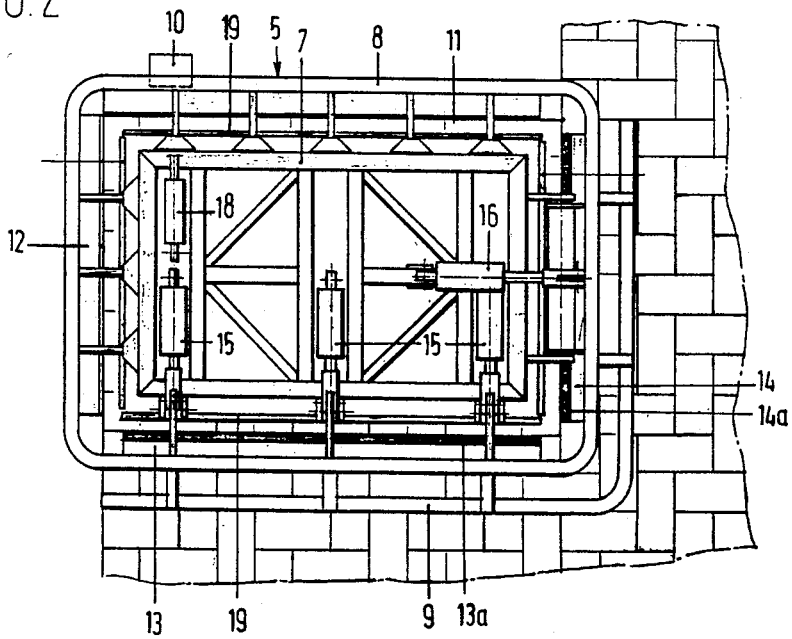
Figure 3:
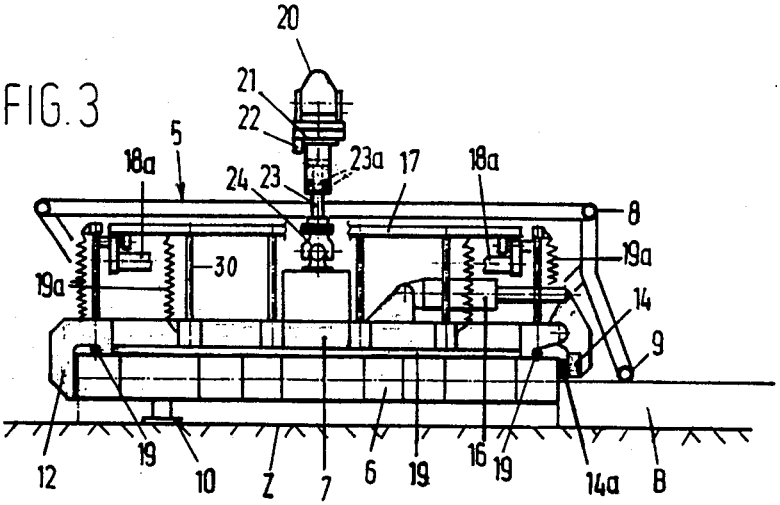

To illustrate the invention, one embodiment of the grab will now be described, by way of example, with reference to the accompanying drawings, in which FIG. 1 shows a paving machine including the grab according to the invention;

FIG. 2 is a plan view of the grab, with a number of parts, such as the suspension means, being omitted for clarity; and FIG. 3 is a part-sectional side-elevational view of the grab.

Referring to the drawings, in particular FIG. 1, there is shown a paving machine comprising a vehicle 1 with a swivelling crane 2, to the jib 3 of which is secured, by suspension means 4, a grab 5. FIG. 1 shows the machine with the vehicle 1 on a part B already paved and a stack of units 6 of stones or bricks arranged in a particular pattern, one of the units 6 being engaged by grab 5 and positioned in contiquity with the part B already paved in spaced relationship over sand bed Z.

As shown in FIGS. 2 and 3, grab 5 comprises a carrier frame 7 carrying a hand rail 8 and a supporting rail 9 and a supporting plate 10 adjustable in height, and by means of which a unit of stones or bricks 6 can be positioned.

The carrier frame 7 also carries four clamping strips 11, 12, 13, and 14, of which in the embodiment shown, strips 11 and 12 are rigidly secured to the carrier frame 7, while strips 13 and 14 are hinged to the carrier frame and are equipped with hydraulic actuating cylinders 15 and 16, respectively. The operative surfaces of the hinging clamping strips 13 and 14 may be covered with a plurality of rubber elements 13*a* and 14*a*, respectively, which on the side facing the stones or bricks are provided with wear-resistant steel strips for protection of the rubber. In this way the grab can take up dimensional tolerances of the bricks.

The hydraulic system for the actuation of cylinders 15 and 16 may be arranged so that when clamping strips 13, 14 are closed, first cylinder 16 is actuated, and cylinders 15 are not actuated until after clamping strip 14 exerts a certain force on the group of stones or bricks 6. The group of stones or bricks is thus first compressed in the longitudinal direction between strips 12 and 14 before being clamped by strips 11 and 13 as well. The clamping is sufficiently great for the group of stones or bricks to be manoeuvred without the stones or bricks being shifted relatively to each other. When the hinging clamping strips 13, 14 are opened, the hydraulic cylinders 15, 16 are actuated all at the same time, so that strips 13 and 14 are opened at the same time and all stones or bricks may fall simultaneously.

In order to prevent tilting of the border stones or bricks, which in fact experience friction from strips 11–14 and also from the pavement already laid, against which, in the embodiment shown, two rows of border stones or bricks are pressed, there is provided a hold-down mechanism for the border stones or bricks, which presses these vertically downwardly onto the sand bed Z as the clamping strips are opened.

In the embodiment shown, the hold-down mechanism comprises a tensioning frame 17 that can be moved up and down relatively to carrier frame 7 by a cylinder 18 via levers 18*a*. From the tensioning frame 17, a plurality of springs 19*a* extend downwardly and are attached to the carrier frame 7, and a plurality of connection rods 30 extend downwardly to separate hold-down strips 19 extending along the inside of the clamping strips 11–14.

Departing from the situation in which the clamping strips 13 and 14 are in the opened position and tensioning frame 17 has been moved upwards so that hold-down strips 19 are not loaded, a group 6 of brick stones or bricks can be engaged. It is only after the clamping strips 13 and 14 have been moved to the closed clamping position and the required clamping force on the unit of stones or bricks has been reached, that the tensioning frame 17 is moved downwards so that the hold-down strips 19 exert a downward force on the rows of border stones or bricks of unit 6, which however is insufficient to force the stones or bricks from the clamped packet. It is only after the unit of stones or bricks has been positioned at the desired location, which can be effected by means of supporting rail 9 on the ready pavement B and the supporting plate 10 on the sand bed Z that the clamping by the strips is released and the hold-down strips 19 are capable of pushing the rows of border stones or bricks downwards together with the falling middle stones or bricks.

The grab 5 is attached to the jib 3 by suspension means including, in the embodiment shown, a universal joint, such as a cardan joint 20, 24, at each end with a freewheel joint, such as a sliding sleeve unit 23 with spring rings 23*a* between them. The freewheel joint 23 in the suspension prevents the transmission of minor vertical movements and vibrations of the crane jib to the unit of stones or bricks as it is being laid on the substrate and as it is being picked up from a stack of such units. The spring means 23*a* function as a buffer during the hoisting of the grab. The suspension arrangement makes it possible for the grab to be optimally adjusted relatively to a stack of units of stones or bricks, relatively to the substrate, and relatively to pavement already laid.

In order to simplify the laying of a group of stones or bricks, the suspension means may include a swivel joint 21 with a lock 22 against rotation, with which preselected settings relative to the crane jib can be rapidly accomplished.

In mechanical paving work, the method and the grab for use therein, according to the invention, make it possible for units or groups of bricks or stones to be positioned in a reliable manner without disturbing the herringbone bond with rectangular concrete paving stones, so that the subsequent insertion of half bricks becomes superfluous. During the release of a positioned unit of stones or bricks it is ensured that all stones or bricks thereof fall vertically downwardly on the sand bed, and the carefully prepared sand bed is not previously disturbed.

It is clear that the invention is not limited to the embodiment described, but that various modifications are possible without departing from the scope of the invention.

What I claim:

1. A method of laying paving, in particular of placing units of paving stones or bricks previously arranged in a selected pattern in a road surface, said method comprising engaging such a unit by clamping at opposite edges and putting it down on a prepared sand bed or like substrate in contiguity with previously laid road surface components while pressing the same into contact with such road surface components, and with a downward force to be exerted on the upper surface of said unit, characterized in that the downward force is exerted on at least the border stones or bricks or border rows bordering the previously laid road surface components at least at the moment when, as the unit is laid down, the clamping at the edges thereof is released.

2. A method according to claim 1, characterized in that, as a unit is released, the downward force is exerted on each row of border stones or bricks, independently of the other rows of border stones of bricks upon which the downward force is exerted.

3. A grab for carrying out a method for laying paving, particularly for placing units of paving stones or bricks previously arranged in a selected pattern in a road surface comprising a carrier frame including suspension means for attachment to a jib of a swivelling crane, and at least one pair of opposite clamping strips operatively connected to said carrier frame cooperating for clamping a unit or group of stones or bricks previously arranged in a pattern, one clamping strip being arranged so as to be movable, and the other being rigid, relatively to said carrier frame, said carrier frame further carrying a hold-down mechanism operative vertically downwardly, characterized in that said hold-down mechanism is operative along at least the inside of said movably arranged clamping strip.

4. A grab according to claim 3, characterized in that said hold-down mechanism comprises one or more hold-down strips each biased downwardly by spring means, said spring means being secured to a tensioning frame movable relatively to the carrier frame between a passive and an active level.

5. A grab according to claim 3, characterized by a supporting rail secured to the carrier frame along the outside of at least one of the clamping strips and at least one supporting plate spaced from said supporting rail, the levels of said supporting rail and of said supporting plate being adjustable so as to enable them to function as level positioning means relative to paving already laid and relative to the sand bed or other substrate.

6. A grab according to claim 3, characterized by a hand rail operatively connected to said carrier frame for maneuvering the grab.

7. A grab according to claim 3, characterized in that said suspension means whereby the carrier frame is suspended from the swivelling crane includes a combination of universal joint means and freewheel joint means.

8. A grab according to claim 4, characterized by a supporting rail secured to the carrier frame along the outside of at least one of the clamping strips and at least one supporting plate spaced from said supporting rail, the levels of said supporting rail and of said supporting plate being adjustable so as to enable them to function as level positioning means relative to paving already laid and relative to the sand bed or other substrate.

* * * * *